US005651568A

United States Patent [19]

Fortune et al.

[11] Patent Number: 5,651,568

[45] Date of Patent: Jul. 29, 1997

[54] PRIVACY SNIB MECHANISM

[75] Inventors: Geoffrey James Fortune, Nunawading; Lawrence John McLaughlan, Eltham, both of Australia

[73] Assignee: Gainsborough Hardware Industries, Limited, Blackburn, Australia

[21] Appl. No.: 564,581

[22] Filed: Nov. 29, 1995

Related U.S. Application Data

[63] Continuation-in-part of Ser. No. 131,954, Oct. 8, 1993, Pat. No. 5,484,177.

[30] Foreign Application Priority Data

| | | | |
|---|---|---|---|
| Oct. 9, 1992 | [AU] | Australia | PL5182 |
| Jan. 27, 1993 | [AU] | Australia | PL6948 |
| Jul. 31, 1995 | [AU] | Australia | 27286/95 |

[51] Int. Cl.[6] ..... E05C 1/06

[52] U.S. Cl. ..... 292/140; 292/169; 292/359

[58] Field of Search ..... 292/140, 169, 292/98, 359, DIG. 30, DIG. 37, DIG. 41

[56] References Cited

U.S. PATENT DOCUMENTS

| | | | |
|---|---|---|---|
| 511,483 | 4/1893 | Chester . | |
| 2,218,183 | 10/1940 | Springer . | |
| 3,471,188 | 10/1969 | Hawkins . | |
| 3,790,196 | 2/1974 | Sanders et al. . | |
| 3,896,645 | 7/1975 | Nagy et al. . | |
| 4,142,748 | 3/1979 | Hook | 292/169 |
| 4,301,667 | 11/1981 | Best et al. . | |
| 4,594,864 | 6/1986 | Hart . | |
| 4,602,490 | 7/1986 | Glass et al. . | |
| 5,029,913 | 7/1991 | Wartian . | |
| 5,123,682 | 6/1992 | Robida et al. | 292/169 |
| 5,436,139 | 7/1995 | Bergen et al. | 292/169 |
| 5,505,508 | 4/1996 | Kuo | 292/359 |

FOREIGN PATENT DOCUMENTS

| | | |
|---|---|---|
| 1439696 | 6/1976 | United Kingdom . |
| 2014641 | 8/1979 | United Kingdom . |

*Primary Examiner*—Rodney M. Lindsey
*Assistant Examiner*—Monica E. Millner
*Attorney, Agent, or Firm*—Sughrue, Mion, Zinn, Macpeak & Seas

[57] ABSTRACT

A snib mechanism for a door latch assembly includes a body, and a rotary member disposed in or on the body and adapted to be engaged and rotated with a door knob spindle. A snib member is mounted on the body for movement between a snibbing position in which the first rotary member is snibbed against rotation and a freeing position in which the first rotary member is free to rotate with the door knob spindle. The body includes a cover plate and the mechanism further includes press-button means associated with the snib member. The press-button means is exposed through an opening in the cover plate and is manually operable by pressing inwardly of the cover plate to set the snib member at the snibbing position.

24 Claims, 12 Drawing Sheets

PRIVACY SNIB MECHANISM

RELATED APPLICATION

This application is a continuation-in-part with respect to U.S. Pat. No. 5,484,177, Ser. No. 131,754, filed Oct. 8, 1993.

FIELD OF THE INVENTION

This invention relates to door lock mechanisms including a releasible privacy snib mechanism and to a releasible snib mechanism adaptable as a privacy snib mechanism.

BACKGROUND ART

U.S. Pat. No. 4,142,748, assigned to the present applicant, disclosed a privacy lock arrangement for door latch assemblies which allows an internal door latch to be snibbed on a first side to lock the latch against entry from the other side, but to be automatically released by simple rotation of the handle at the first side. Privacy lock arrangements in general ensure privacy for the occupant of a room against unexpected entry and are widely used on bathroom, toilet and bedroom doors. The particular arrangement of U.S. Pat. No. 4,142,748 includes a pair of rotary members which interengage with one another so that they can rotate independently through a limited angle of rotation only. A pivoted snib member has a first dog engageable with one of the rotary members to positively lock it against rotation and a second dog which engages the other rotary member in such a way that the relative rotation of the rotary members is effective to move the snib member out of its engagement with the locked rotary member.

The arrangement of U.S. Pat. No. 4,142,748 has the attraction that it may be provided as an adaptor assembly between a backing plate and an escutcheon and therefore does not require modification of the handle, but is also a relatively complex mechanism to manufacture.

Earlier privacy lock arrangements are to be found, for example, in U.S. Pat. No. 3,471,190, and in British patents 861002 and 1159161.

A variation of the arrangement of U.S. Pat. No. 4,142,748 is disclosed in the present applicant's co-pending Australian patent application 19655/92. In that case, the engagement between the releasing rotary member and the snib is by way of a lateral pin on the snib which projects parallel to the main spindle axis and is received in a V-shaped cut-out in a head portion of the rotary member.

In the present applicant's international patent publication WO9310324, respective first and second rotary members include respective notches which are disposed mutually adjacent when the rotary members are at a predetermined relative position, to both receive a commentary lug on a snib member. One of the notches and the lug effect snibbing of the first rotary member while the other notch is effective as camming means during mutual rotation to act on the lug to move the snib member to its freeing position. The snib member is again a pivoted component exposed through the rim of the backing plate for being set against an indexing spring.

Related background art cited in WO9310324 included WO90/15210, U.S. Pat. No. 3,800,573 and U.S. Pat. No. 5,123,682.

It is an object of the invention to provide on one hand, a novel snib mechanism and, on the other, a door lock mechanism incorporating same.

SUMMARY OF THE INVENTION

In one aspect, the invention provides a door lock mechanism including a body, and a moveable cam member mounted on the body. Retractor means adapted to drive a latch bolt is supported for sliding movement in response to movement of the cam member. Key actuated lock means is associated with the cam member for locking the retractor means against said sliding movement. Hand operator means is rotatable from either side of a door in situ, on an axis offset from the key actuated lock means, for sliding the retractor means in a first direction to retract the latch bolt from a latch position to a release position, when the retractor means is not locked by the lock means. The mechanism further includes automatically releasible privacy snib mechanism associated with the hand operator means.

In a preferred embodiment of this aspect of the invention, the privacy snib mechanism includes respective rotary members each adapted to be operatively coupled to a respective manual door latch operator on respective sides of a door panel. Means is provided for drivingly coupling a first of the rotary members, which is further from the door panel than a second of the rotary members, to a mechanism for sliding said retractor means in said first directions to retract the latch bolt from a latch position to a release position. Respective mutually co-operate first formations are on the rotary members whereby a prescribed rotation of the second rotary member is effective to rotate the first rotary member. A snib member has an associated finger engageable element whereby the snib member is moveable from a freeing position to a snibbing position in which the inner second rotary member is locked against rotation. Respective mutually co-operable second formations are provided on the first rotary member and on the snib member whereby rotation of the first rotary member to slide the retractor means is effective to automatically release the snib member for the snibbing position.

Preferably, the body includes a cover plate and the mechanism further includes press-button means comprising the finger-engageable element associated with the snib member, which press-button means is exposed through an opening in the cover plate and is manually operable by pressing inwardly of the cover plate to set the snib member at the snibbing position.

In another aspect, the invention provides a releasible snib mechanism for a door latch assembly, including a body, and a first rotary member disposed in or on the body and adapted to be engaged and rotated with a door knob spindle. A snib member is mounted on the body for movement between a snibbing position in which the first rotary member is snibbed against rotation and a freeing position in which the first rotary member is free to rotate with the door knob spindle. A second rotary member disposed in or on the body adjacent the first rotary member is adapted to be engaged by and rotated by a shaft means, the second rotary member being arranged upon initial rotation of said shaft means to move the snib member from the snibbing position to the freeing position and upon continued rotation of the shaft means to provide rotation to the first rotary member. Said body includes a cover plate and the mechanism further includes press-button means associated with the snib member, which press-button means is exposed through an opening in the cover plate and is manually operable by pressing inwardly of the cover plate to set the snib member at the snibbing position.

In one embodiment of the invention, according to either aspect, the snib member comprises a snib plate having a lug, which snib plate is pivotable between the snibbing and freeing positions such that the lug thereon correspondingly moves substantially parallel to the axis of rotation of the first rotary member between positions in which the lug respectively engages and does not engage the first rotary member.

In an alternative embodiment, the snib member comprises a snib plate slidable generally parallel to the cover plate between the snibbing and freeing positions. The snib plate may include an aperture or recess to receive the press-button means and an oblique cam surface adjacent the aperture or recess and engageable by the press-button means to slide the snib plate transversely with reference to the direction of movement of the press-button means.

Indexing spring means may be provided for biasing the snib member to its freeing and snibbing positions. The indexing spring means may comprise a pair of U-shaped springs mounted at respective sides of the snib plate relative to its direction of sliding movement.

The first and second rotary members may include respective fist and second formations which are disposed mutually adjacent when the rotary members are at a predetermined relative rotational position, for cooperating with a complementary snib formation on the snib member, the first formation and snib formation effecting said snibbing of the first rotary member and the second formation being effective as camming means during the initial rotation to act on the snib member to move the snib member to said freeing position.

The second rotary member preferably comprises a plate having a centre disc portion and a pair of peripherally disposed, preferably diametrically opposite, lobes. The second rotary member is preferably locked in said snibbing position by engaging a lug on the snib member with one of these lobes while a further lug on the first rotary member, comprising one of said first formations, engaging the other lobe.

Advantageously, the second rotary member may be mounted at selective angular positions relative to the first rotary member which per se define respective directions of said prescribed rotation of the operator on the other side of the door. In a still further aspect, the invention provides a snib mechanism for a door latch assembly, comprising:

a body including a cover plate;

a rotary member disposed in or on said body and adapted to be engaged and rotated with a door knob spindle;

a snib plate mounted on the body for sliding movement generally parallel to said cover plate between a snibbing position in which said rotary member is snibbed against rotation and a freeing position in which said rotary member is free to rotate with the door knob spindle; and press-button means associated with said snib plate, which press-button means is exposed through an opening in the cover plate and is manually operable by pressing inwardly of said cover plate to set the snib plate at said snibbing position, including an oblique cam surface engageable by the press-button means to slide the snib plate transversely with reference to the direction of movement of the press-button means.

BRIEF DESCRIPTION OF THE DRAWINGS

The invention will now be further described, by way of example only, with reference to the accompanying drawings, in which:

(FIGS. 16 is reversed relative to FIG. 13)

DESCRIPTION OF PREFERRED EMBODIMENTS

Figure 1:
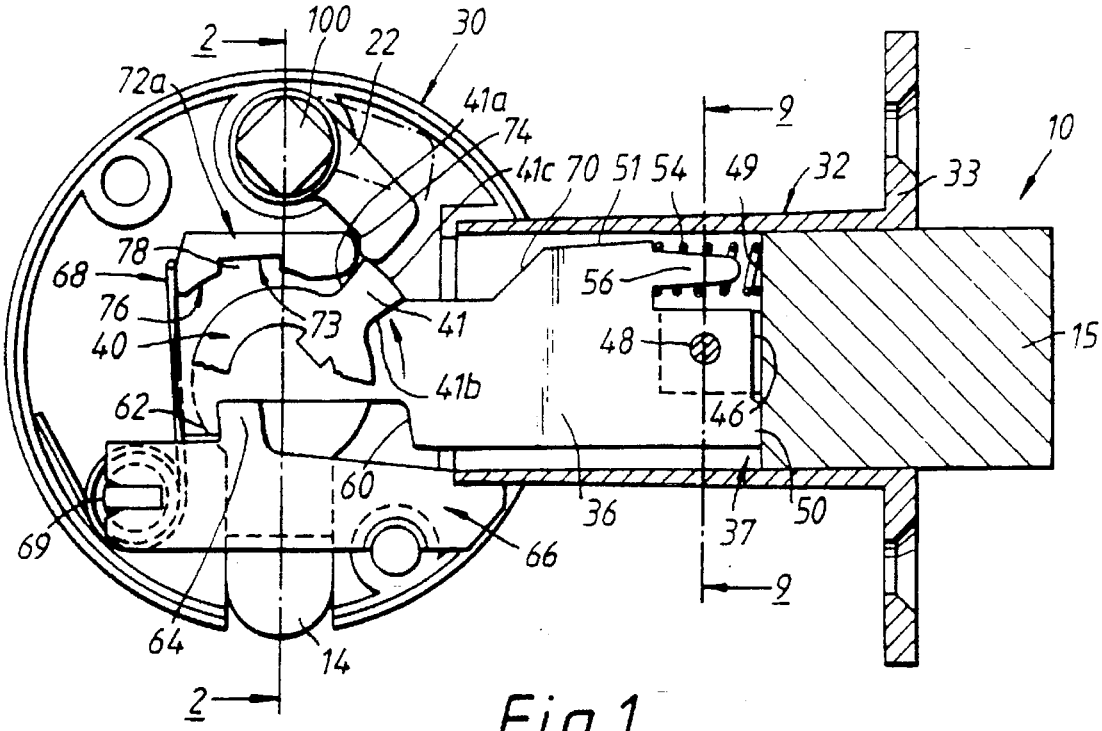
FIG. 1 is a somewhat diagrammatic cross-sectional view of a dual function lock assembly taken on the vertical plane at the centre line of the latch bolt, and showing the latch bolt in its latch position.
Figure 2:
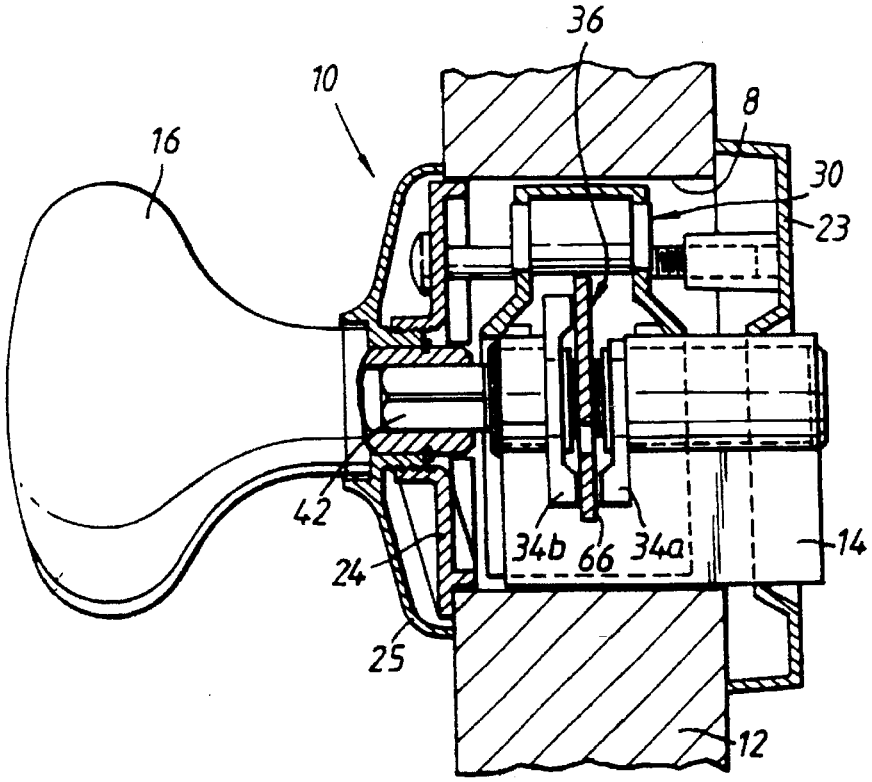
FIG. 2 is a cross-section on the line 2—2 in FIG. 1, ie at the vertical plane containing the common axis of the main operator spindles.
Figure 3:
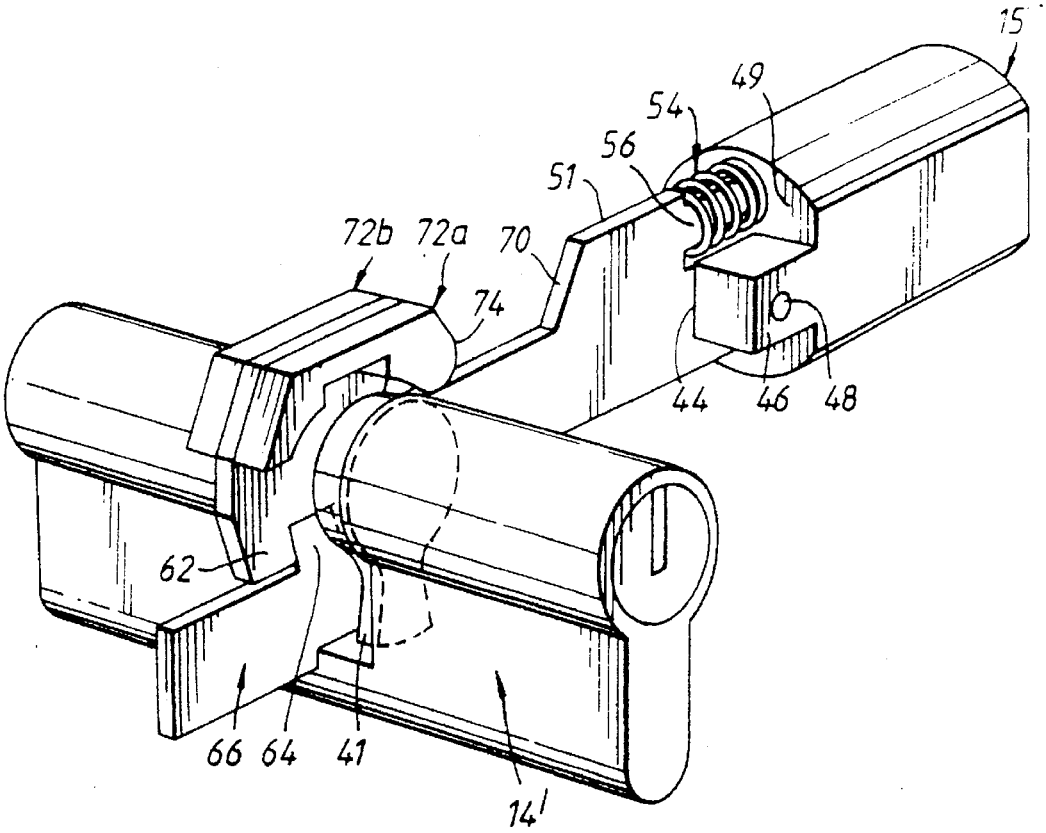
FIG. 3 is a fragmentary isometric sketch view of a slightly modified embodiment, depicting the relative arrangements of the latch bolt, centre retractor plate, index lever and a dual cylinder lock.

The illustrated dual function lock assembly 10 depicted, with variations, in FIGS. 1 to 15 is shown mounted to a door leaf 12 and is depicted in somewhat diagrammatic form with some of the detail of external components omitted for sake of clarity. The assembly includes a latch bolt 15, a cylinder key lock 14 operable from the outside of the door, and a manual knob operator 16 for operation from the inside of the door. The assembly is further provided with the usual external facilities such as a face plate 23 to position cylinder lock 14, and a mounting set for knob 16 including threadably interengaged backing plate 24 and escutcheon 25. The latter provides a bearing for knob 16.

The usual cavities in the door leaf seat a main body or housing 30 and a latch bolt casing 32. The cavity for main housing 30 is a standard cylindrical bore 8, eg of 54 mm diameter, and the ability to mount the mechanism within such a standard cylindrical bore is an advantage of the preferred embodiments of the mechanism. Main housing 30 is a two-part cast assembly embracing the cylinder lock 14, respective cam members **34*a*,34*b* associated with the cylinder lock and with the knob operator 16, retractor means in the form of a slidable centre retractor plate 36 forming a snub-assembly 37 with latch bolt 15, and a crank 22. Crank 22 shown in FIGS. 1, 4, 5 and 6 forms part of an alternative latch operator mechanism described later in connection with FIGS. 11 and 12 and is not required in the lock assembly shown in FIG. 2. Although in the embodiment of FIGS. 1, 2 and 4 to 9, crank 22** is not operational, it is provided as a standard component so that the mechanism is adaptable to a variety of alternative configurations.

Latch bolt casing 32 provides a close sliding fit for latch bolt 15 and has an integral external facing plate 33 on the edge of the door. Latch bolt 15 would engage the normal strike plate and cavity (not shown) on the door jamb. For this purpose, the latch bolt has the usual angled face to allow automatic retraction from the latch position when the door is closed.

Latch bolt/retractor sub-assembly 37, and accordingly latch bolt 15, have three operating positions: a retracted or release position (FIG. 4) in which the latch bolt is retracted into casing 32 to allow the door to be opened; an intermediate-throw latch position (FIG. 1) in which the latch bolt is readily retracted to the release position by simply turning the handle of the latch operator mechanism 16, or by using the key in cylinder lock 14, and an extended throw lock position in which greater security is afforded by setting the latch bolt in a "deadlock" position.

Each cam member 34*a*,34*b* is of a conventional type comprising an annular member or ring 40 and one or more integral projecting wings 41 defined between respective radial edges 41*a*,41*b* and an outer arcuate edge 41*c* concentric with the ring. Cam member 34*a* is coupled to the key released spindle of cylinder lock 14, while cam member 34*b* rotates with a square spindle 42 splined in a blind bore of knob 16.

Centre retractor plate 36 is positioned to reciprocate centrally between the opposed, spaced faces of cam members 34*a*,34*b*. At its forward end, plate 36 extends into a slot 44 defined between two rear rectangular lugs 46 of the latch bolt, and is pivoted to the latch bolt on a transversely extending pin 48. The angular range of pivotal movement of plate 36 is quite small: the lowered position is determined by a lug 50 at the rear corner of the plate striking the main rear face 49 of latch bolt 15 (FIG. 1), while the upper limit is determined by engagement between a slightly inclined upper edge 51 of the plate with the interior surface of latch bolt casing 32. The plate is biased to the lower position by a helical compression spring 54 mounted about a rearwardly projecting tapered spring post 56 on plate 36, between the rear face 49 of the latch bolt and stop surfaces at the base of post 56.

Figure 9:
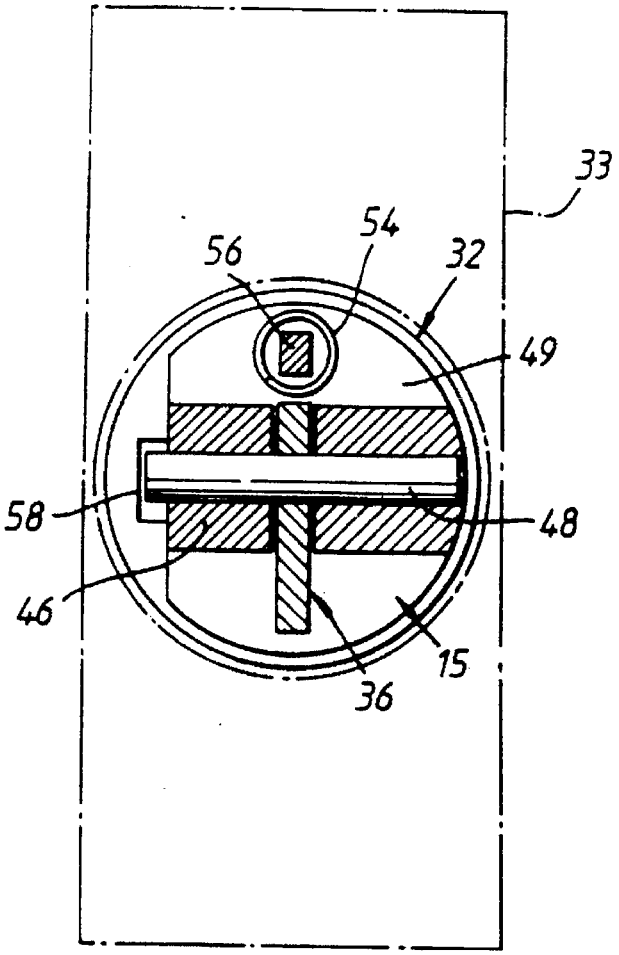
FIG. 9 is a cross-section on the line 9—9 in FIG. 1.

As best seen in FIG. 9, pivot pin 48 projects at one side into a guide slot 58 in the side wall of latch bolt casing 32. This slot defines the limits of travel of sub-assembly 37 and also retains the sub-assembly in the latch bolt casing.

Towards its rear end, retractor plate 36 has a bight 60 in its lower edge which serves to define a depending lug 62 at the bottom rear corner of the plate. The intermediate latch position of the assembly is defined by the engagement of this lug 62 behind a complementary upstanding lug 64 on an index plate 66 retained in main housing 30 under and coplanar with the retractor plate 36. It will thus be appreciated that index plate 66 also extends between cam members 34*a*,34*b*. The whole assembly 37 is biased to this intermediate latch position by a generally upstanding inverted-U shaped spring 68 which engages behind the upper rear edge of plate 36. This spring has respective terminal coils 69 by which it is mounted to either side of index plate 66: this shape allows plate 36 to pass between the arms of the spring, a requirement which will become better understood subsequently.

The upper edge of retractor plate 36 has a more centrally located bight 70 and behind this bight 70 each side of the plate is fitted with a respective outstanding land 72*a*,72*b*. These lands are substantially identical and define a lower edge 73 of somewhat complex shape which interacts with the or each respective wing 41 of cam members 34*a*,34*b*. Successive features of this shape will now be described in turn with reference to the operational movements of the assembly.

The forward edge of each land 72*a*, 72*b* provides a rounded nose 74. The position of each nose is such that, when the assembly 37 is in its intermediate latch position, the respective cam member can be rotated to bring the wing 41 into engagement with the nose 74 (the position actually shown in FIG. 1). Further rotation of the cam member will cause the wing 41 to push the land 72 and thereby drive the retractor plate 36, and hence the latch bolt 15, against spring 68 back toward the rear wall of main casing 30. The rearward limit is the release position shown in FIG. 4 and it will be seen that the latch bolt 14 has thereby been withdrawn into latch bolt casing 32, and the door unlatched.

If the cam member is now turned back over 90° the other way, spring 68 will ensure prompt return of the assembly 37 to the intermediate latch position shown in FIG. 1.

Figure 5:
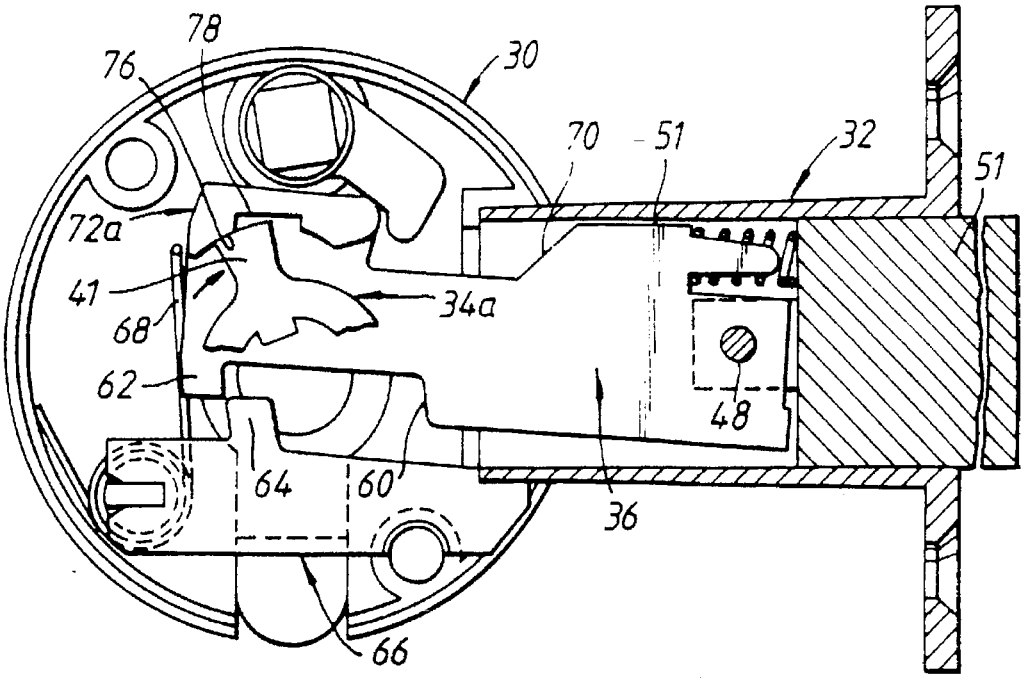
FIGS. 5, 6 and 7 are views similar to FIGS. 1 and 4 but show the assembly at successive stages during its movement to the lock position.

If the cam member 34*a* or 36*b* is rotated in a clockwise direction, it will engage a rear inclined portion 76 of the lower edge of land 72. Further rotation of the wing 41 will cause the wing to lift the land 72, and thereby pivotably lift plate 36 until lug 62 is cleared from behind lug 64 and wing 41 can move further in under the edge 73, as shown in FIG. 5. Wing 41 can now seat in a rectangular recess 78 of edge 73 until its strikes the forward vertically depending boundary 80 of recess 78. Further rotational movement of the cam member will now drive land 72 and therefore the whole of assembly 37 forwardly until lug 62 is cleared over and past lug 64. This is the position shown in FIG. 6. It will be seen that recess 78 must be of sufficient length to accommodate the changing relative configuration of wing 41 during this segment of the motion. At this forward position, edge 72 is concavedly chamfered at 82 to allow wing 41 to move forwardly out of recess 78 and to commence its downward movement. Initially as it does so, spring 54 biases retractor plate 36 pivotally downwardly to drop lug 62 in front of lug 64 (FIG. 7). Can member 34*a*,34*b* can freely return to the bottom-most position for retraction of the key. The latch bolt is now in an extended deadlocked position, in which it cannot be forced back because of the positive engagement of lug 62 against lug 64.

Figure 4:
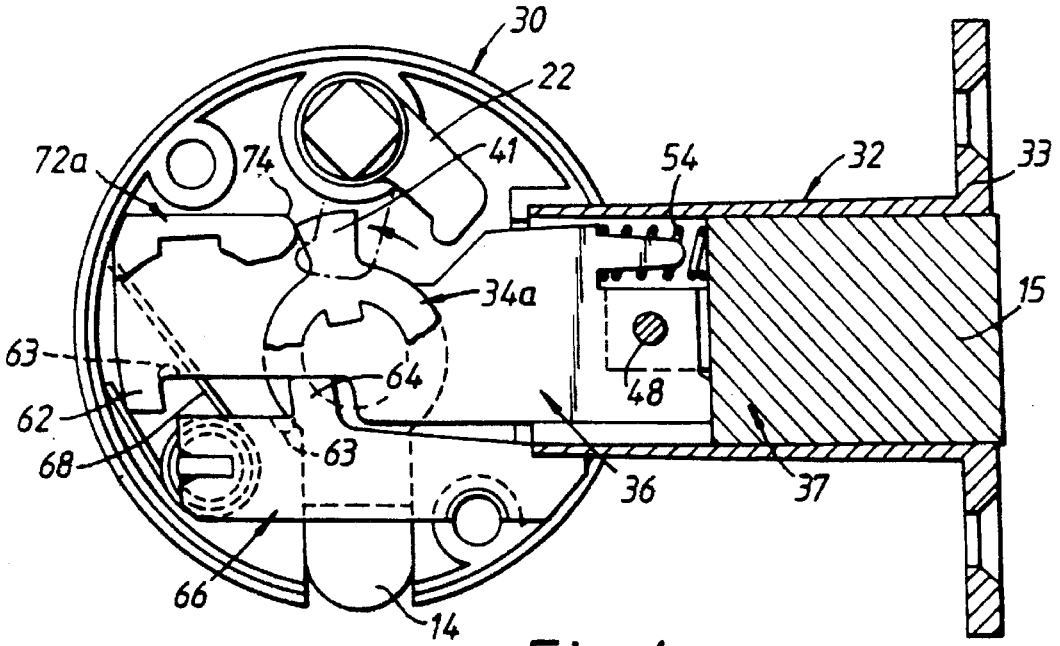
FIG. 4 is a view similar to FIG. 1 but showing the latch bolt in its door release position.

To facilitate the disengagement of lug 62 from behind lug 64, curved notches may be provided adjacent each lug, in retractor plate 36 and index plate 66 as depicted at 63 in FIG. 4.

Figure 6:
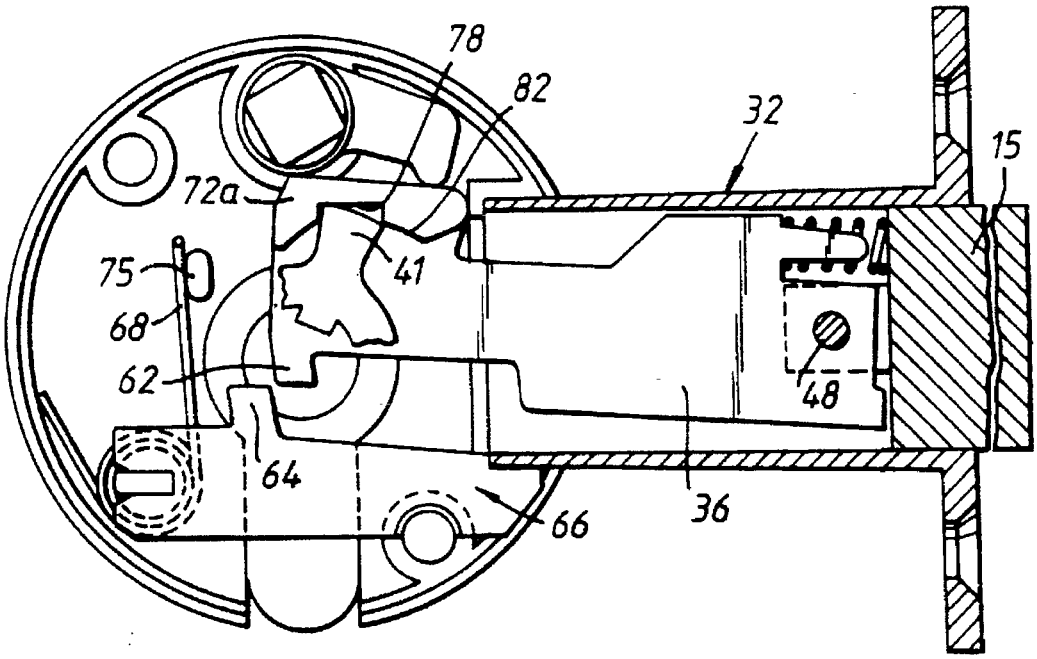
Figure 7:
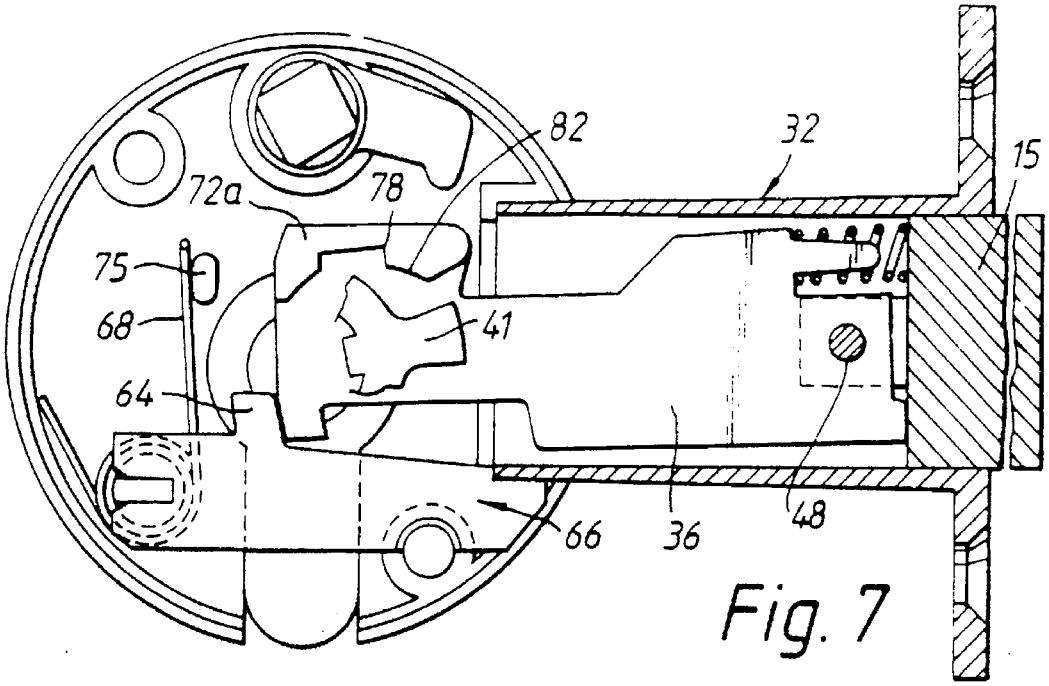

It will be appreciated from an inspection of FIGS. 6 and 5 that the just described motion is reversible. If cam member 34*a*,34*b* is rotated anti-clockwise from a bottom position, the wing 41 will strike the forward end segment 84 of edge 73 behind nose 74 (which is itself now too far forward to be struck by the wing). The wing will then again lift land 72, and therefore retractor plate 36 up to clear lug 62 from in front of lug 64. At this point, the position of FIG. 6 will have been again reached and further anti-clockwise movement of wing 41 will force land 72 and therefore subassembly 37 back to the position of FIG. 5, whereupon again spring 54 will cause lug 62 to drop behind lug 64 as the wing is cleared away from land 72.

It should be noted that at the intermediate latch position of assembly 37, main spring 68 strikes a stop 75 (FIG. 6) on the side wall of main cavity 30 so that, during the action of lifting retractor plate 36 to clear lug 62 from behind lug 64, the spring is not acting on the plate. This provision helps avoid the risk of jamming which might otherwise occur if the spring were still acting on the plate.

Figure 8:
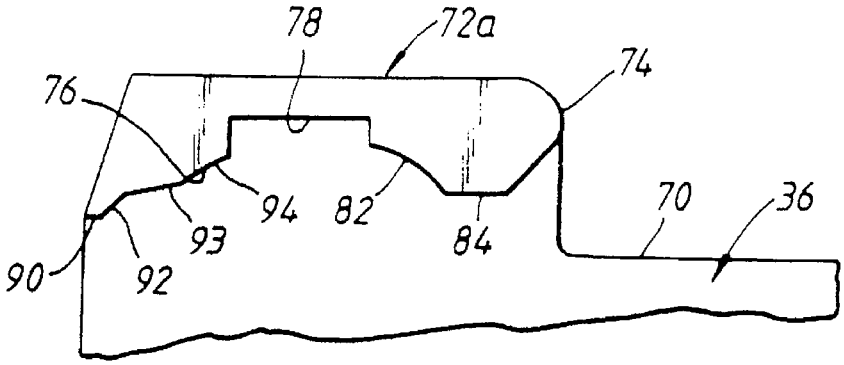
FIG. 8 is an enlarged elevational view of a segment of the retractor plate, but showing a modified shape for part of the retractor plate.

To further reduce the risk of jamming a modified shape of rear portion 76 of edge 73 may be provided as detailed in the enlarged view of FIG. 8. It will be seen that edge portion 76 has a rear small horizontal segment 90 which is first struck by the forward corner of wing 41 to commence the lift, a second small segment 92 approximately complementary to the shape of the outer arcuate edge 41*c* of the wing, a third inwardly angled portion 93, and a fourth segment 94 which is curved to complement the arcuate edge 41*c* of the wing. The angle between segments 92,93 provides a seat for the corner of the wing which assists in holding retractor plate 36 against any tendency to move forward as it is lifted: such forward movement would cause increased pressure between lug 62, 64 and might thereby cause jamming. Segment 94 rides smoothly along the arcuate edge of the wing as it passes, although at this point there is no serious difficulty if the retractor plate begins to move forward, since lug 62 has now been cleared from behind lug 64.

It may be necessary to provide similar features of shape along edge segments 82,84.

As already explained, crank 22 is shown in FIGS. 1 and 4 to 7 but is not an operational part of these embodiments. However, if forms an operational component of an alternative embodiment depicted in FIGS. 11 and 12. In this case, the respective cam members 34*a*,'34*b*' are both operated by cylinder locks and indeed FIG. 3 applies to this embodiment and shows a standard double cylinder lock for this purpose. In this case, the deadlocking function is enhanced by providing for key locking from both sides of the door and the latching function is controlled by a separate knob operate 16' provided on another axis. A useful feature of this embodiment is that, while the latch bolt may be moved to the deadlocked position by key actuation from either side of the door, is not necessary for a person to unlock both sides for the deadlocked position to be fully released.

Figure 10:
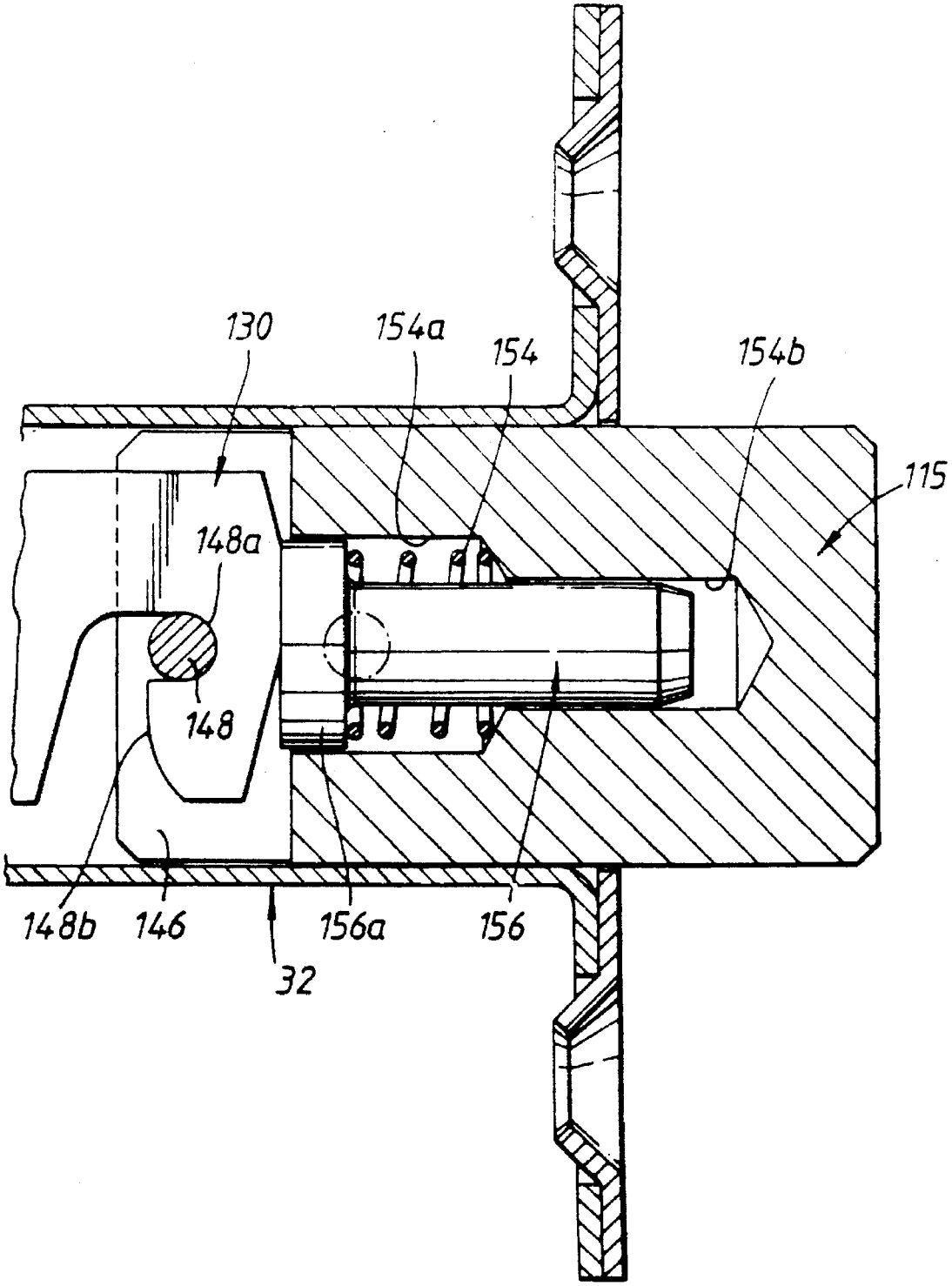
FIG. 10 shows an alternative arrangement for coupling the retractor plate to the bolt.

FIG. 10 shows an alternative arrangement for coupling retractor plate 136 to latch both 115. In this case, pivot pin 148 is fixed between lugs 146 of the latch bolt and locates in a complementary rounded side notch 148*a* at the end of a slot 148*b* in plate 136 shaped so the plate can be readily engaged with the pin, and therefore with the latch bolt 115, by hooking the plate about the pin. In this case, spring 154 is provided in a counterbored outer portion 154*a* of a blind bore 154*b* in the rear of latch bolt 115. The spring acts between a shoulder defined by the counterbore and the head 156*a* of a stud 156 disposed in the blind bore. Stud head 156*a* is biased by the spring against the end of retractor plate 136.

Figure 11:
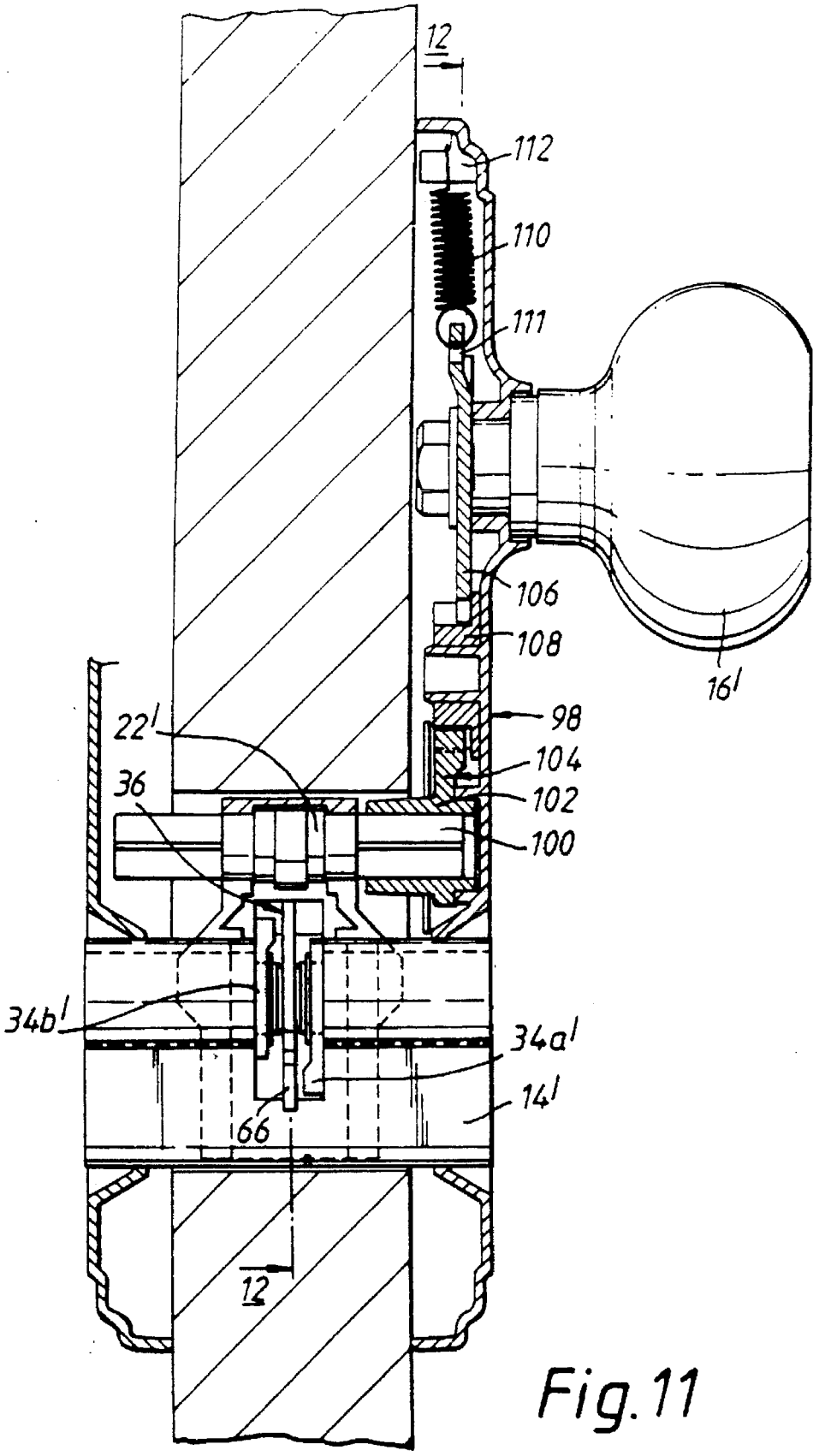
FIG. 11 is a transverse coaxial view of the modified embodiment corresponding to FIG. 3 but showing in detail an alternative manual actuator assembly for withdrawing the latch bolt to its release position.
Figure 12:
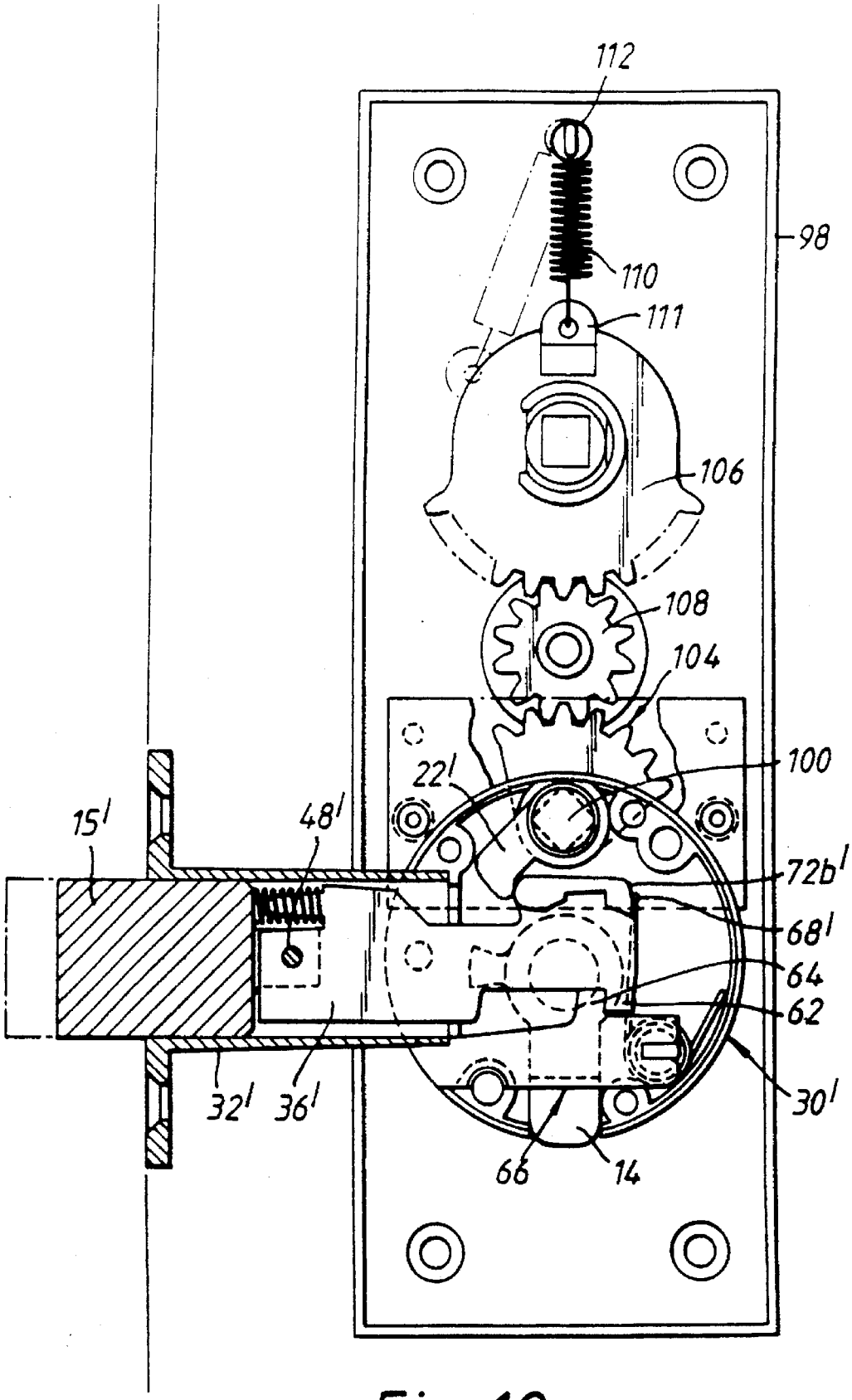
FIG. 12 is a combination cross-section on the line 12—12 in FIG. 11.

Turning to FIGS. 11 and 12, crank 22' is driven by knob 16' via a suitable gear transmission mounted within a cover plate 98 on one side, typically the inside, of the door. Crank 22' is shaped to seat neatly in bight 70 in front of registered noses 74' of lands 72', and thereby to pull the retractor plate back to the release position in a similar fashion to wings 41'. The crank 22' is depicted with a distinct side protrusion 22*a* but it may be preferable for this protrusion to be a less pronounced shallower convexity of relatively large radius. In that event, the protrusion extends less into bight 70 than illustrated.

Crank 22' is fixed at the centre of a spindle 100 extending across the door and operates between the two winged cam members 34*a*,34*b* and so doses not obstruct their paths of movement. Spindle 100 is of square section by which it is keyed in the boss 102 of a toothed segment 104. Knob 16' carries a complementary toothed segment 106 and the two segments are drivingly coupled by a pinion 108 rotatably mounted on the inside face of cover plate 98. The knob is biased to a neutral central position by a helical tension spring 110 mounted between a lug 111 at the centre top of toothed segment 106 and a stud 112 at the top of cover plate 98.

It will be seen that the illustrated dual function mechanism is adapted for mounting in a standard cylindrical latch mechanism hole in a door and does not requite additional cavity space. The provision of the retractor component as a simple plate facilitates easy manufacture and assembly and in particular avoids the need for a more complex cast component.

Figure 15:
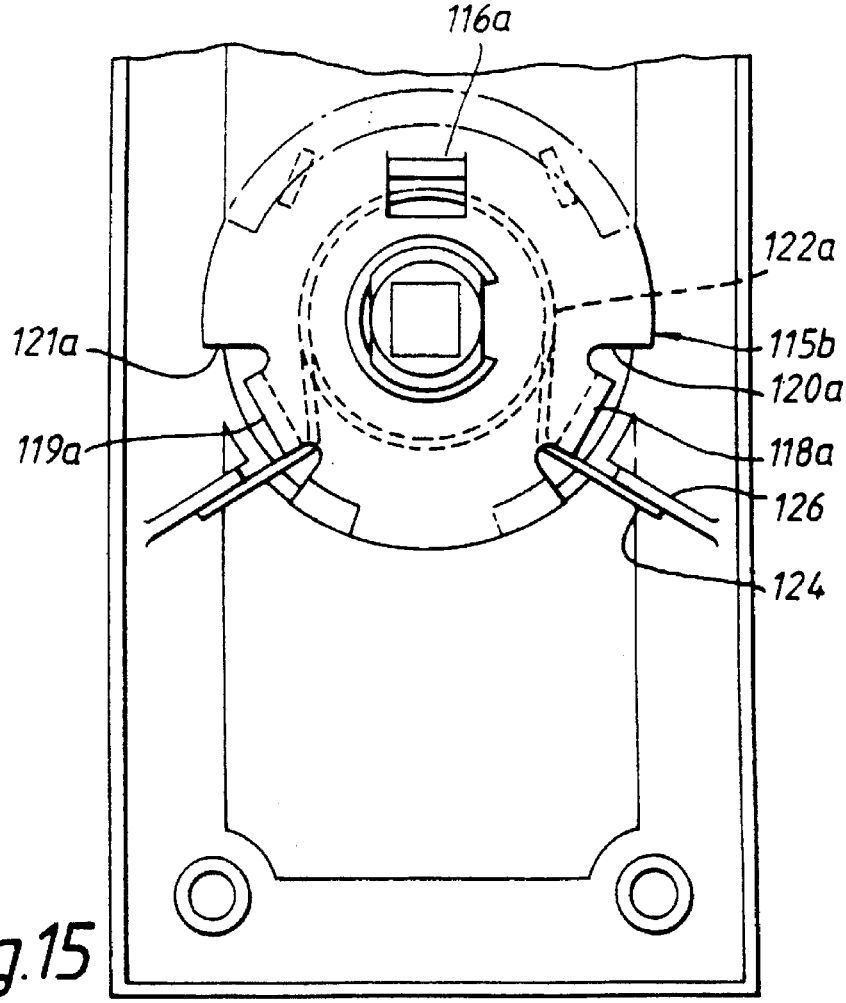
FIG. 15 is a cross-sectional view "X" in FIG. 13.
Figure 13:
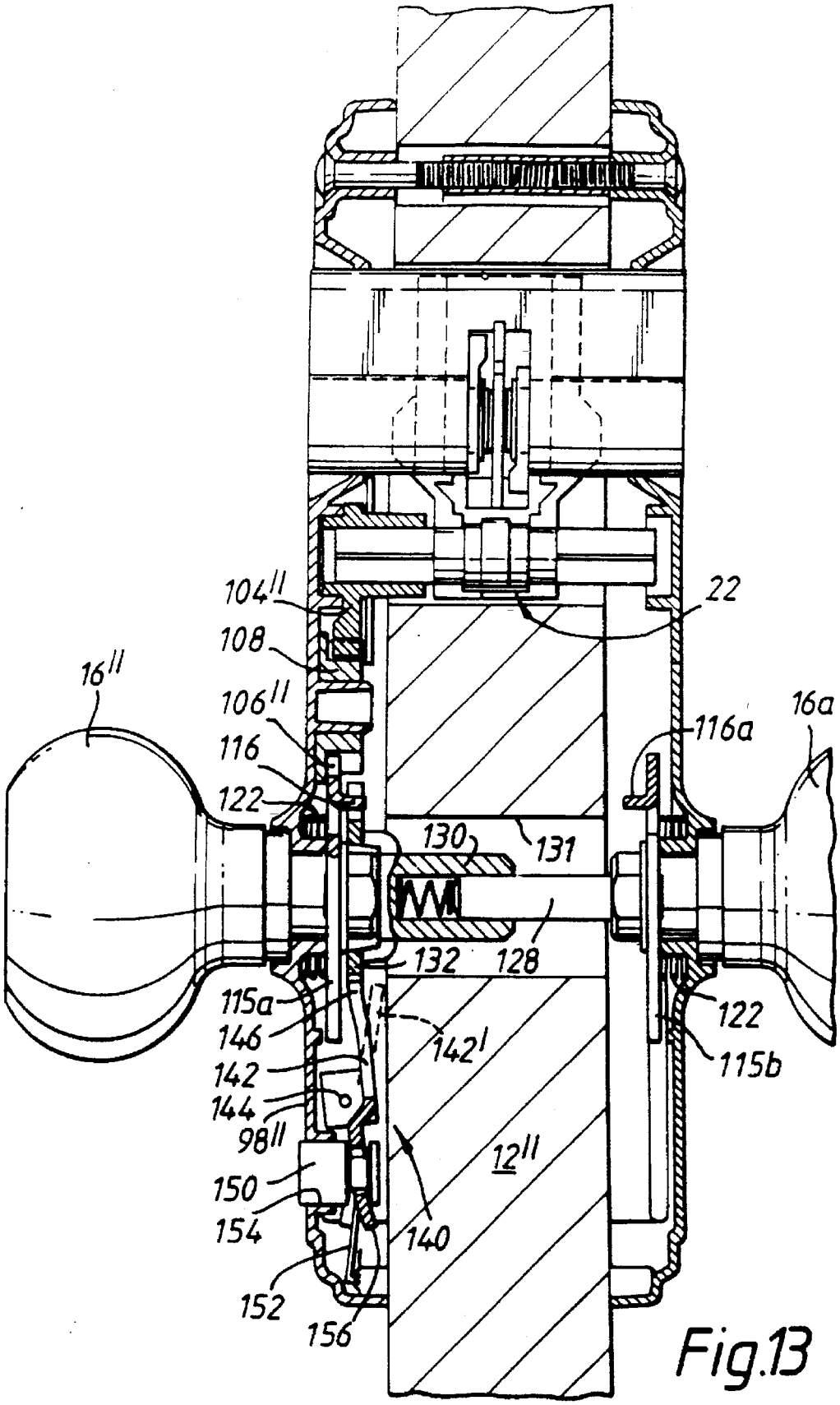
FIGS. 13 and 14 are views similar to FIGS. 11 and 12 but showing a modified manual actuator assembly which incorporates a first embodiment of a privacy snib mechanism according to the invention.
Figure 14:
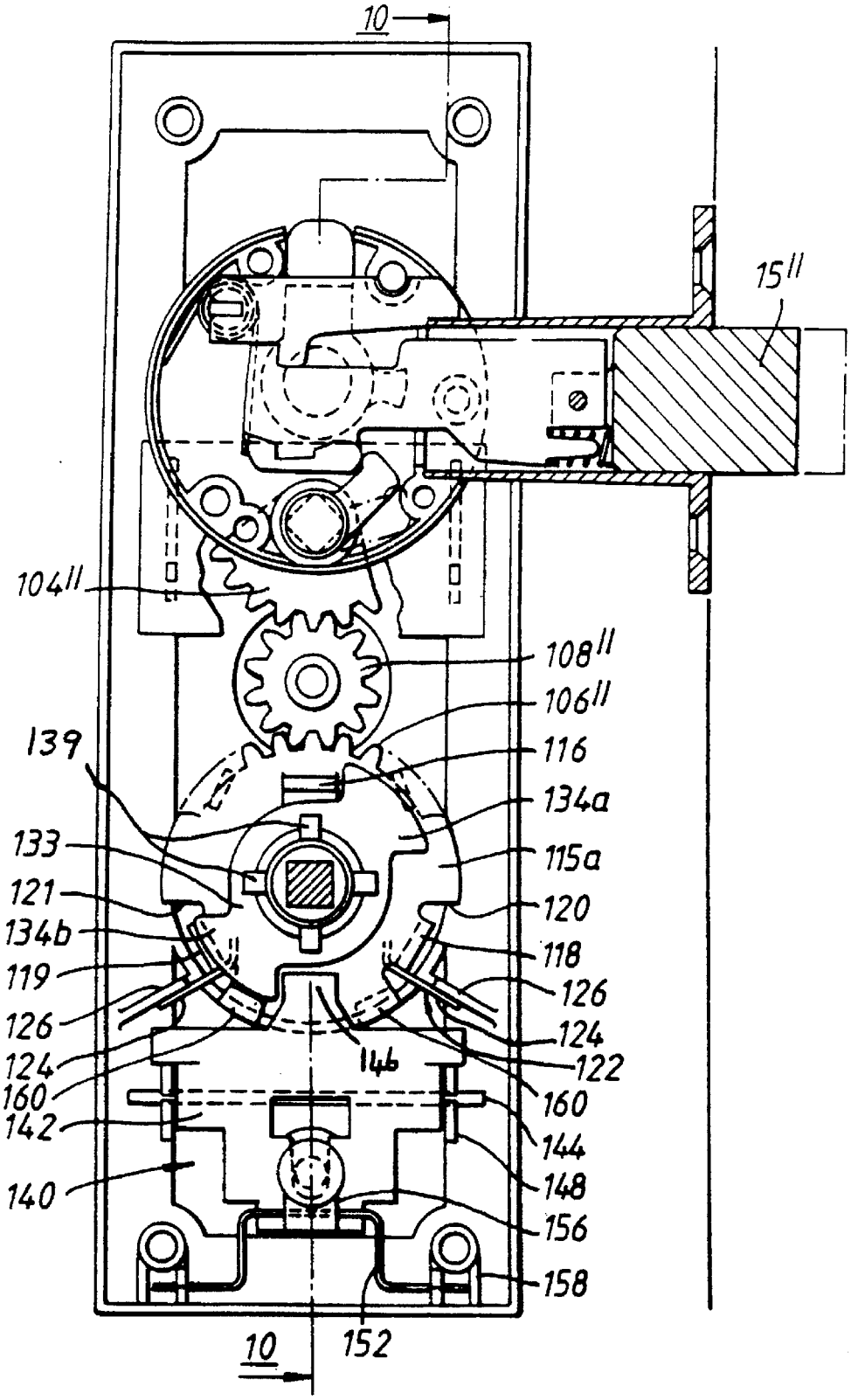
Figure 16:
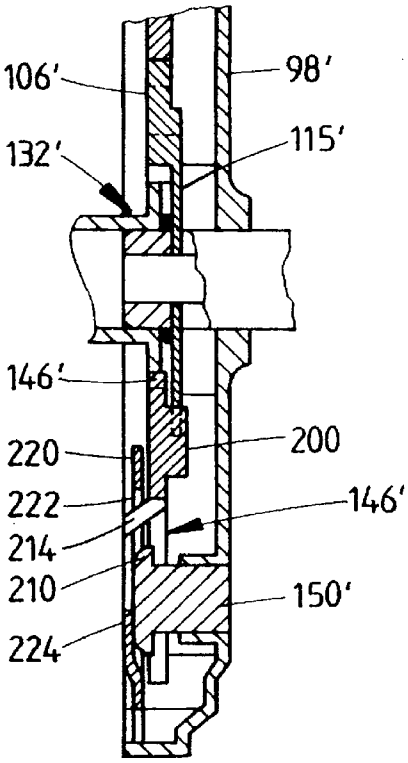
FIG. 16 and 17 are views similar to parts of FIGS. 13 and 14 showing a second embodiment of privacy snib mechanism according to the invention, with the snib plate shown in the snibbing position
Figure 17:
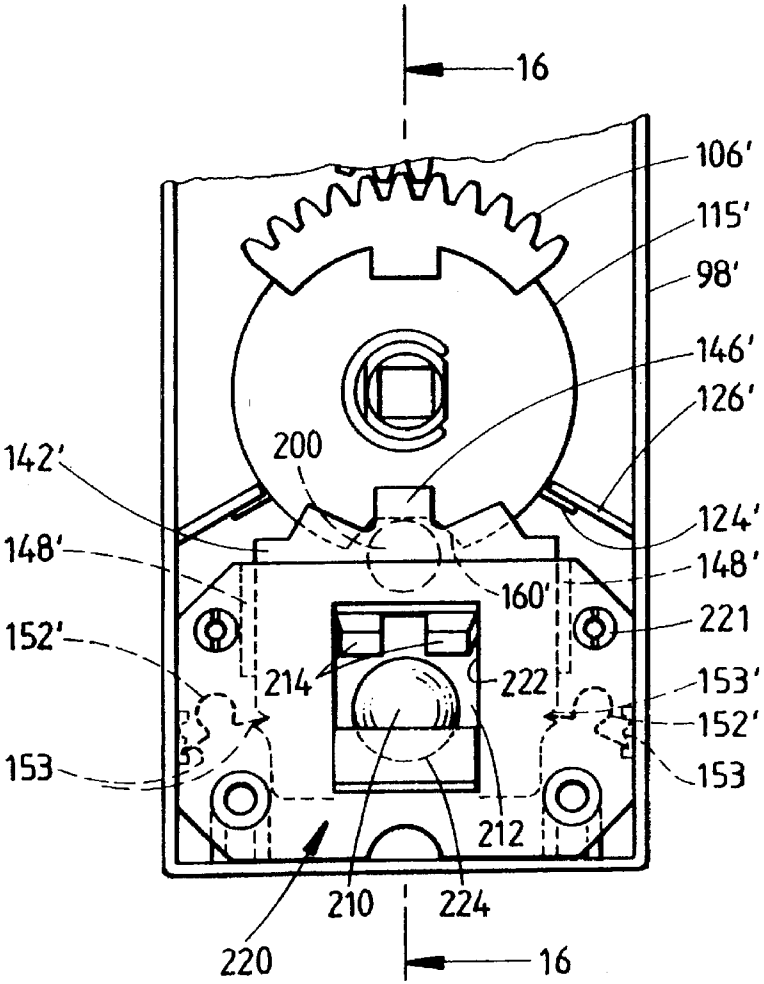
Figure 18:
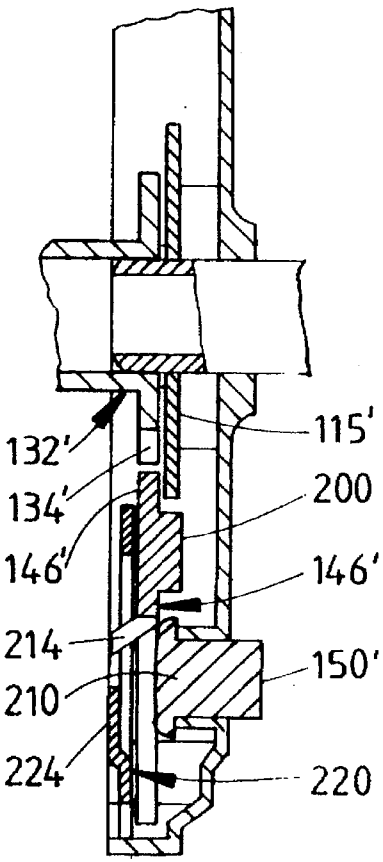
FIGS. 18 and 19 are views corresponding to FIGS. 16 and 17 but showing the snib plate in its freeing position.
Figure 19:
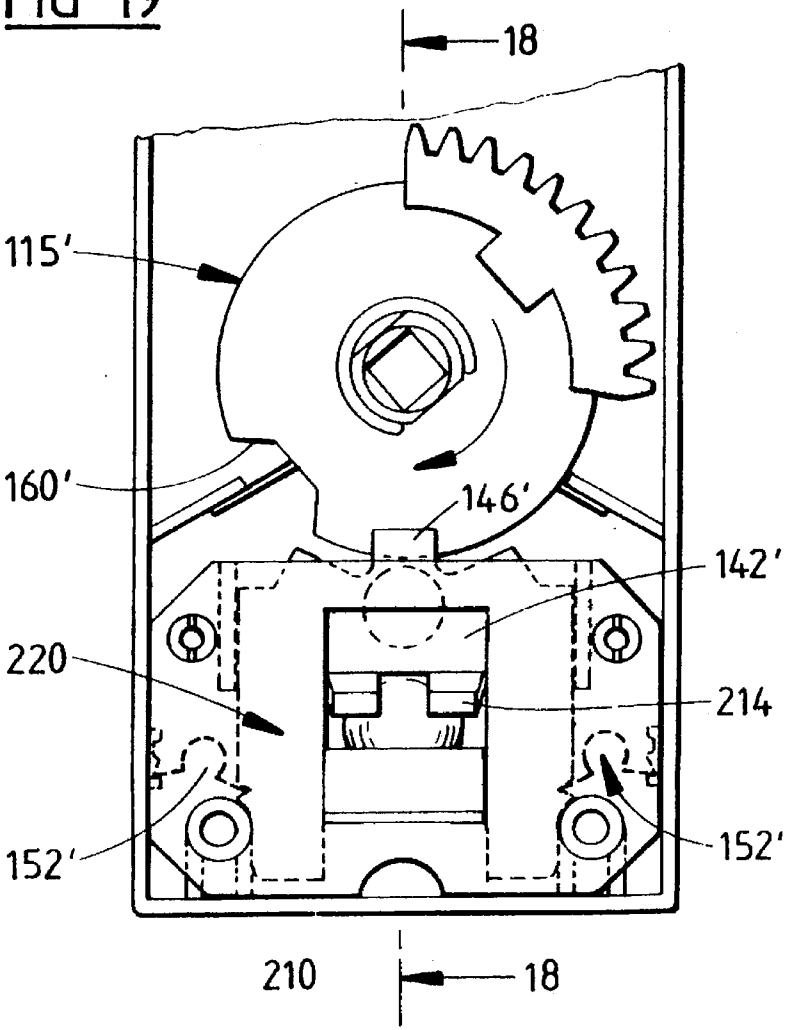

FIGS. 13 to 15 illustrate a further modification in which the knob 16" is one of a coupled pair of knobs 16",16*a* which are disposed below rather than above the latch bolt 15" and provide a privacy snib function. Knob 16" is at the inside of the door while knob 16*a* is at the outside. Inside knob 16" again carries a toothed segment 106" which drives toothed segment 104" via a pinion 108". However, in this embodiment, toothed segment 106" is integrally provided on a rotary member substantially in the form of a drive disc 115*a*. Drive disc 115*a* is irrotationally fixed to the square-section spindle of knob 16". The disc has an upper flat lug 116 which projects parallel to the axis of knob 16" towards the door, and is formed by pressing a tab from the disc. Two further lugs 118,199 are pressed angularly the other way, at approximately 4 and 8 o'clock positions on the disc, at the inner rim of peripheral notches 120,121. The outside knob 16*a* carries a similar drive disc 115*b*. Instead of tension spring 110, each drive disc 115,115*a* is biased to a neutral central position, with lug 116 at the top, by a coil spring 122, 122*a* having terminal end tabs 124 which engage past the respective adjacent end edges of lugs 118,119 to contact aligned limit seats 126.

Knob 16*a* is coupled to drive disc 115*a*, and therefore to crank 22, via a spindle extension 128 which irrotationally engages a matching axial socket 130 of a further rotary member 132. Spindle extension 128 and socket 130 extend across bore 131 in the door. Rotary member 132 overlies and is coaxial with drive disc 115*a*. It has a centre disc portion 133 joined to socket 130 by four peripherally spaced frangible links 139. Links 139 are designed to shear break under a predetermined load and will therefore fail if an attempt is made to force the lock by applying a wrench or like device to knob 16*a*.

Rotary member 132 further includes a pair of diagonally opposite peripheral lobes 134 which, in the neutral central position of the knob 116*a*, are disposed with one, 134*a*, having an end edge adjacent an end of lug 116. If outside knob 16*a* is rotated in the appropriate direction, lobe 134*a* of rotary member 132 will normally engage lug 116 and thereby rotate disc 115, thereby driving crank 22. It will be appreciated that knob 16*a* may be readily set during installation to be operable in one or other rotational directions by disposing rotary member 132 with lug 134*a* on the appropriate angular side of lug 116.

Knob 16*a* may be temporarily locked against operation by setting a privacy snib mechanism 140. Snib mechanism 140 includes a shaped snib plate 142 which is pivotable on a longitudinally extending hinge pin 144 between a freeing position (broken lines 142' in FIG. 13) and a snibbing position in which an upstanding lug 146 on the top edge of snib plate 142 lies in the plane of rotary member 132, adjacent the other non-drive lobe 134*b* and diagonally opposite and in lateral dimensional register with lug 116. This relationship is best seen in FIG. 14, from which it will also be appreciated that the rotary member 132 is now locked by lug 146 against operatively rotation to engage and move lug 116.

Hinge pin 144 of snib plate 142 extends, between retention posts 148 on the inside of cover plate 98" parallel to the door panel and therefore normally to the common axis of the spindles of the two knobs 16",16*a*. The snib plate 142 is fitted below pin 144 with a press-button 150 for setting the snib plate to the snibbing position, and with a cranked indexing spring 152 for biasing the snib plate to its freeing and snibbing positions to either side of an intermediate position. Press-button 150 is exposed through an opening 154 in cover plate 98". Indexing spring 152 is retrained at its centre under a deflected tab 156 at the lower end of the snib plate, and at its ends in retention posts 158.

Rotary member 132 may have two pairs of generally opposite lobes 134*a*, 134*b* to minimize free travel at the outside knob.

Disc 115 is configured for automatically freeing snib plate 142 on rotation of knob 16", by virtue of obliquely ramped peripheral cam surfaces 160 adjacent notches 120, 121. On rotation of disc 115, in either direction, one or other of these surfaces 160 engages the root region of lug 146 and automatically pushes the snib plates back above hinge pin 144 to its freeing position.

It will be appreciated that snib mechanism 140 allows an occupant of a house to set latch bolt 15 at its intermediate-throw latch position and snib plate 142 at its snibbing position, thereby achieving a degree of security while inside but allowing movement outside, eg to do gardening, without needing a key, by simply rotating knob 16" to operate crank 22 and so withdraw the latch bolt. This same action automatically frees snib plate 142—so leaving the door unlocked for ready return without a key. On returning inside, the occupant can again ensure a degree of security and privacy, still without a key, by resetting the snib mechanism.

In a further alternative construction, privacy snib mechanism 140 may, instead of comprising a discrete plate 142 and spring 152, be formed as a one piece plate of spring metal of the type which is mounted to snap between the freeing and snibbing positions. Another possible variation is to eliminate the intermediate pinion 108, 108", for example, by enlarging the toothed segments 104, 106 so that they directly mesh.

A still further alternative embodiment is illustrated in FIGS. 16 to 19, in which like parts are represented by like primed reference numerals. The principal variation is that snib plate 142' is not pivotably mounted but is instead a plate of generally inverted U configuration which is slidable to the spindle axes in a track defined by outstanding side rails 148'. Snib plate 142' carries a co-planar rectangular lug 146' at its upper edge for engaging notch 134 in a rotary member 132' (shown only in FIGS. 16,18) to snib it against rotation, when plate 142' is in its snibbing position. The plate is cammed to its freeing position by the action of ramped side edges 160' of a notch on disc 115' on a boss 200 which projects integrally from the front surface of plate 142' below lug 146'.

Indexing spring means is provided in this embodiment by a pair of spring and U-shaped springs 152' positioned at each side of plate 146' in respective shallow V-notches 153 in the snib plate and cover plate so that the loops of the springs are maximally compressed when plate 146' is midway between its snibbing and freeing positions. In this way the spring bias snib plate 142' to its respective freeing and snibbing positions.

In this case press-button 150' has a rear camming head 210 which is received by the recess 212 in snib plate 142' between its arms, and acts on a pair of internal obliquely trailing lugs 214 behind the recess, to slidably cam the plate from its freeing to its snibbing position. The necessary rear constraint on plate 142' to ensure this sliding response is provided by a rear cover plate 220 which is fastened by screws 221 on to the main cover plate 98' in contact with snib plate 142. This plate 220 includes an opening 222 to accommodate lugs 214, and an offset panel portion 224 behind opening 222 to limit depression of press-button 150'.

Conversely, when plate 142' is pushed down by disc 115' via ramped side edges 160', lugs 214 cam press-button 150' outwardly to its outer position.

We claim:

1. A door lock mechanism comprising:

a body;

a moveable cam member mounted on the body;

retractor means adapted to drive a latch bolt and supported for sliding movement in response to movement of the cam member;

key actuated lock means associated with the cam member for locking the retractor means against said sliding movement;

hand operator means rotatable from either side of a door in situ, on an axis offset from said key actuated lock means, for sliding the retractor means in a first direction to retract the latch bolt from a latch position to a release position, when the retractor means is not locked by said lock means; and an automatically releasible privacy snib mechanism associated with said hand operator means.

2. A door lock mechanism according to claim 1, wherein said privacy snib mechanism comprises:

respective rotary members each adapted to be operatively coupled to a respective manual door latch operator on respective sides of a door panel;

means for drivingly coupling a first of said rotary members, which is further from the door panel than a second of the rotary members, to a mechanism for sliding said retractor means in said first direction to retract the latch bolt from a latch position to a release position;

respective mutually co-operable first formations on said rotary members whereby a prescribed rotation of the second rotary member is effective to rotate the first rotary member;

a snib member with an associated finger engageable element whereby the snib member is moveable from a freeing position to a snibbing position in which said inner second rotary member is locked against rotation; and respective mutually co-operable second formations on the first rotary member and on the snib member whereby rotation of the first rotary member to slide the retractor means is effective to automatically release the snib member from said snibbing position.

3. A door lock mechanism according to claim 2, wherein the second rotary member comprises a plate having a centre disc portion and a pair of peripherally disposed lobes.

4. A door lock mechanism according to claim 3, wherein the second rotary member is locked in said snibbing position by engaging a lug on the snib member with one of said lobes while a further lug on the first rotary member, comprising one of said first formations, engages the other lobe.

5. A door lock mechanism according to claim 2 wherein the second rotary member is mounted at selective angular positions relative to the first rotary member which per se define respective directions of said prescribed rotation of the operator on the other side of the door.

6. A door lock mechanism according to claim 1 wherein said body includes a cover plate and said mechanism further includes press-button means comprising said finger-engageable element associated with said snib member, which press-button means is exposed through an a opening in the cover plate and is manually operable by pressing inwardly of said cover plate to set the snib member at said snibbing position.

7. A door lock mechanism according to claim 6 wherein said snib member comprises a snib plate having a lug, which snib plate is pivotable between said snibbing and freeing positions such that said lug thereon correspondingly moves substantially parallel to the axis of rotation of the first rotary member between positions in which the lug respectively engages and does not engage the first rotary member.

8. A door lock mechanism according to claim 6 wherein the snib member comprises a snib plate slidable generally parallel to said cover plate between said snibbing and freeing positions.

9. A door lock mechanism according to claim 8 wherein said snib plate includes an aperture or recess to receive said press-button means and an oblique cam surface adjacent said aperture or recess and engageable by the press-button means to slide the snib plate transversely with reference to the direction of movement of the press-button means.

10. A door lock mechanism according to claim 1 further indexing spring means for biasing the snib member to its freeing and snibbing positions.

11. Adoor lock mechanism according to claim 8 further including indexing spring means for biasing the snib member to its freeing and snibbing positions wherein the indexing spring means comprising a pair of U-shaped springs mounted at respective sides of the snib plate relative to its direction of sliding movement.

12. A releasible snib mechanism for a door latch assembly, comprising:

a body;

a first rotary member disposed in or on said body and adapted to be engaged and rotated with a door knob spindle;

a snib member mounted on the body for movement between a snibbing position in which said first rotary member is snibbed against rotation and a freeing position in which said first rotary member is free to rotate with the door knob spindle; and a second rotary member disposed in or on said body adjacent the first rotary member and adapted to be engaged by and rotated by a shaft means, said second rotary member being arranged upon initial rotation of said shift means to move said snib member from said snibbing position to said freeing position and upon continued rotation of said shaft means to provide rotation to said first rotary member;

wherein said body includes a cover plate and said mechanism further includes press-button means associated with said snib member, which press-button means is exposed through an opening in the cover plate and is manually operable by pressing inwardly of said cover plate to set the snib member at said snibbing position.

13. A releasible snib mechanism according to claim 12 wherein said snib member comprises a snib plate having a lug, which snib plate is pivotable between said snibbing and freeing positions such that said lug thereon correspondingly moves substantially parallel to the axis of rotation of the first rotary member between positions in which the lug respectively engages and does not engage the first rotary member.

14. A releasible snib mechanism according to claim 12 wherein the snib member comprises a snib plate slidable generally parallel to said cover plate between said snibbing and freeing positions.

15. A releasible snib mechanism according to claim 14 wherein said snib plate includes an aperture or recess to receive said press-button means and an oblique cam surface adjacent said aperture or recess and engageable by the press-button means to slide the snib plate transversely with reference to the direction of movement of the press-button means.

16. A releasible snib mechanism according to claim 12 further including indexing spring means for biasing the snib member to its freeing and snibbing positions.

17. A releasible snib mechanism according to claim 14 further including indexing spring means for biasing the snib member to its freeing and snibbing positions wherein the indexing spring means comprising a pair of U-shaped spring mounted at respective sides of the snib plate relative to its direction of sliding movement.

18. A releasible snib mechanism according to claim 12 wherein said first and second rotary members include respective fist and second formations which are disposed mutually adjacent when said rotary members are at a predetermined relative rotational position, for cooperating with a complementary snib formation on the snib member, the first formation and snib formation effecting said snibbing of the first rotary member and said second formation being effective as camming means during said initial rotation to act on said snib member to move said snib member to said freeing position.

19. A releasible snib mechanism according to claim 18 further including means to bias said rotary members to said predetermined relative rotational position.

20. A releasible snib mechanism according to claim 19 wherein said biasing means comprises a coil spring which is disposed within said body and is compressible by respective projection means on the rotary members.

21. A snib mechanism for a door latch assembly, comprising:

a body including a cover plate;

a rotary member disposed in or on said body and adapted to be engaged and rotated with a door knob spindle;

a snib plate mounted on the body for sliding movement generally parallel to said cover plate between a snibbing position in which said rotary member is snibbed against rotation and a freeing position in which said rotary member is free to rotate with the door knob spindle; and press-button means associated with said snib plate, which press-button means is exposed through an opening in the cover plate and is manually operable by pressing inwardly of said cover plate to set the snib plate at said snibbing position, including an oblique cam surface engageable by the press-button means to slide the snib plate transversely with reference to the direction of movement of the press-button means.

22. A snib mechanism according to claim 21 further including indexing spring means for biasing the snib plate to its freeing and snibbing positions.

23. A snib mechanism according to claim 22 wherein the indexing spring means comprising a pair of U-shaped springs mounted at respective sides of the snib plate relative to its direction of sliding movement.

24. A snib mechanism according to claim 21 further including means associated with the rotary member for automatically moving the snib plate from the snibbing to the freeing position on rotation of a door knob in snib.

* * * * *